US011478829B2

(12) United States Patent
Johnson et al.

(10) Patent No.: US 11,478,829 B2
(45) Date of Patent: Oct. 25, 2022

(54) PRESCRIPTION BOTTLE LABEL DEGRADER

(71) Applicant: ScrapeItRx LLC, Fairfield, CT (US)

(72) Inventors: Edward M. Johnson, Fairfield, CT (US); David L. Harvey, Fairfield, CT (US); James M. Valentine, Fairfield, CT (US)

(73) Assignee: ScrapeItRx LLC, Fairfield, CT (US)

( * ) Notice: Subject to any disclaimer, the term of this patent is extended or adjusted under 35 U.S.C. 154(b) by 866 days.

(21) Appl. No.: 16/009,948

(22) Filed: Jun. 15, 2018

(65) Prior Publication Data

US 2019/0009311 A1 Jan. 10, 2019

Related U.S. Application Data

(60) Provisional application No. 62/580,772, filed on Nov. 2, 2017, provisional application No. 62/527,747, filed on Jun. 30, 2017.

(51) Int. Cl.

| | |
|---|---|
| ***B08B 9/08*** | (2006.01) |
| ***B08B 9/087*** | (2006.01) |
| ***B08B 9/38*** | (2006.01) |
| ***B24D 15/04*** | (2006.01) |
| ***B08B 1/00*** | (2006.01) |

(52) U.S. Cl.

CPC ..... *B08B 9/083* (2013.01); *B08B 1/005* (2013.01); *B08B 9/087* (2013.01); *B08B 9/0835* (2013.01); *B08B 9/38* (2013.01); *B24D 15/04* (2013.01); *B08B 2220/01* (2013.01)

(58) Field of Classification Search

CPC ..... B08B 9/083; B08B 9/0835; B08B 9/087; B08B 9/38; B08B 1/005; B08B 2220/01; B67B 7/16; B24B 23/08; B24B 27/003; B24B 5/52; B24B 5/23; B24D 15/04; B24D 15/023; B24D 15/02; B29C 63/0013

USPC ..... 451/523, 490, 502, 524, 552, 557; 81/3.29, 3.4, 3.56, 407; 30/299, 303, 304

See application file for complete search history.

(56) References Cited

U.S. PATENT DOCUMENTS 1,497,165 A 6/1924 Bottomley
1,620,822 A * 3/1927 Lawson ..... F02B 77/04 15/104.012

(Continued)

OTHER PUBLICATIONS

LabelNator Bottle Blade, Retrieved on Sep. 14, 2017 from https://labelpeelers.com/equipment/bottles/labelnator-bottle-blade/?gclid=EAlalQobChMInfGehYCl1gIV2rXACh3imAeZEAQYAiABEgJ2H_D_BwE.

*Primary Examiner* — Monica S Carter
*Assistant Examiner* — Marcel T Dion
(74) *Attorney, Agent, or Firm* — Forge IP, PLLC

(57) ABSTRACT

A simple hand held label degrading device and method employs a molded polymer ring (collar) having a plurality of molded hardened pointed teeth on the internal circumference projecting radially inward for degrading the label of a prescription bottle or the like inserted therein. A longitudinal slot in the collar allows it to be fitted over a bottle such that simple hand squeezing of the collar compresses the collar around the bottle and engages the pointed teeth against the label. Simple hand twisting of the collar around the bottle in a clockwise or counterclockwise rotation cuts through the plastic composite or paper label and shreds the label rendering sensitive information illegible thus protecting personal health information. The bottles can then be thrown away or recycled without fear of medical identity theft.

19 Claims, 7 Drawing Sheets

(56) References Cited

U.S. PATENT DOCUMENTS 2,227,421 A * 1/1941 Bjork ..... B67B 7/30 30/1.5
3,232,146 A * 2/1966 Behn ..... B67B 7/16 81/3.08
3,745,622 A * 7/1973 DeAmicis ..... B23D 71/00 407/29.1
3,883,953 A * 5/1975 Saullo ..... B26B 3/04 30/304
4,509,784 A * 4/1985 Vollers ..... B67B 7/18 294/99.1
4,723,465 A * 2/1988 Hughes ..... B67B 7/44 81/3.4
4,944,832 A 7/1990 Abe et al.
5,168,660 A * 12/1992 Smith ..... B08B 9/021 15/104.04
5,177,909 A * 1/1993 Klocke ..... B24D 15/023 451/490
5,295,278 A * 3/1994 Condon ..... A46B 5/0012 15/104.04
5,317,794 A 6/1994 Lerner et al.
5,388,297 A 2/1995 Ross
5,679,210 A 10/1997 Thomas
5,713,248 A * 2/1998 Franco ..... B67B 7/18 81/3.43
5,718,030 A 2/1998 Langmack et al.
6,080,053 A * 6/2000 Marvin ..... B24B 33/04 451/526
6,098,497 A 8/2000 Larose
6,212,721 B1 * 4/2001 Borodulin ..... B65D 41/026 215/322
6,666,110 B1 12/2003 Buettner
7,267,031 B1 9/2007 Burton et al.
7,412,999 B2 8/2008 Lvovskiy et al.
8,162,024 B2 4/2012 Pierce
8,459,578 B1 6/2013 Fischer
8,479,797 B1 * 7/2013 Hurst ..... B08B 9/083 156/762
8,601,697 B2 * 12/2013 Whittaker ..... B26D 3/169 30/101
9,061,533 B2 6/2015 McHugh
9,949,559 B2 4/2018 Rosenblum et al.
10,046,440 B1 * 8/2018 Colombo ..... B24D 15/04
2006/0207390 A1 * 9/2006 Kehoe ..... B67B 7/40 81/3.4
2008/0052846 A1 * 3/2008 Kapoor ..... A47L 11/4011 15/52.1
2008/0083301 A1 * 4/2008 Messina ..... B65F 1/12 81/3.08
2008/0110298 A1 * 5/2008 Monk ..... B67B 7/16 81/3.08
2009/0007737 A1 * 1/2009 Pierce ..... B26D 3/282 83/15
2009/0277306 A1 * 11/2009 Elwell ..... B67B 7/18 81/3.4
2010/0019012 A1 1/2010 Hurst
2010/0043267 A1 2/2010 Sterling
2011/0180640 A1 * 7/2011 Angel ..... B02C 18/0007 241/36
2012/0023689 A1 * 2/2012 Weinberger ..... A47J 37/0786 15/111
2015/0283632 A1 * 10/2015 Ursuliak ..... B23D 71/08 29/76.1
2015/0327661 A1 * 11/2015 Rosenblum ..... A46B 9/02 134/6

* cited by examiner

PRESCRIPTION BOTTLE LABEL DEGRADER

FIELD OF THE INVENTION

The present invention relates to a simple hand held label degrading device and method for prescription bottles, in connection with which a simple hand twisting of the device around the bottle in a clockwise or counterclockwise rotation cuts through the plastic composite or paper label and shreds the label, thereby rendering sensitive information illegible and thus protecting personal health information.

BACKGROUND OF THE INVENTION

Medical identity theft is a growing problem. The label of a prescription bottle contains information concerning the patient's name, drug, refills remaining, dosage, prescribing doctor, pharmacy, and prescription number. In some cases the only additional information that is required to fill a prescription is a patient's date of birth. The U.S. Federal Trade Commission recommends that to help keep personal health information (PHI) secure one should: "Destroy the labels on prescription bottles before you throw them out."

Currently, no simple method exists to remove the personal medical information from a prescription bottle label. Pharmacists and patients are faced with a choice of writing over labels with a pen or marker, scraping them off by hand with a knife or sharp edge instrument or discarding them with personal medical information left intact on the label. (In the case of pharmacists, this would appear to be a clear violation of HIPPA mandates.) A far better solution would be to render the sensitive information on the bottles labels illegible, thus allowing patients to comfortably dispose of them in the waste or recycling stream.

Thus, what is needed is a quicker, safer and more complete method to render the label illegible. The invention described herein provides a novel and useful solution as compared to traditional methods that can be cumbersome, expensive, and potentially pose a safety concern.

Several other hand held devices for label removal are described in the prior art, although none are as simple, effective and low cost as the present invention. Indeed the present invention has been conceived and designed to become an everyday household item intended to be found in each of the more than 60 million U.S. households with prescription bottles.

U.S. Pat. No. 8,162,024 to Pierce describes a hand held bottle label remover that is generally directed at removing a label, such as that from a wine bottle, while maintaining the integrity of the label. The device of Pierce includes a guide, cutting instrument (preferably a blade) and a base, and is directed at removing a layer from a cylindrical object in a non-destructive manner.

Given the configuration of the device disclosed in Pierce, it is unlikely that the device would be able to be applied to a small prescription bottle; and if so, the PHI would remain intact on the label and require a second step to render it shredded or destroyed.

Similar concepts to Pierce are offered in commercial form under the tradenames LabelNator Bottle Blade™ and Scotty Peeler. The LabelNator Bottle Blade™ appears as a curved blade in a plastic handle and requires that the glass bottle be soaked in water before the device is applied to remove the label in what appears to be a non-degraded form. The Scotty Peeler is a hand held apparent blade mounted in a long handled plastic device. Neither of these devices would be useful for small cylindrical plastic pharmacy vials. Both rely on the use of blades rather than hardened teeth and therefore introduce the user to safety issues not seen in the present invention.

U.S. Pat. No. 5,679,210 to Thomas describes a hand held trigger activated needle that can be used as a cutter to remove labels; but it is not apparent how the device of Thomas would be useful in shredding the label on a prescription bottle.

U.S. Patent Application Publication No. US 2010/0043267 A1 to Sterling discloses a label information redactor for removing or covering PHI on prescription bottles. It appears to use adhesive strips placed over a label to peel away the label or the information on it. The adhesive holding a label to a vial and the plastic coating over the label suggests that a simple external adhesive strip as proposed by Sterling may not be effective in reliably removing or destroying PHI.

While the above approaches of Thomas and Sterling are generally hand held and may remove PHI, they are not directed at shredding and rendering illegible the PHI on a prescription bottle as in the present invention.

More complicated motorized devices, some of which are hand held, are disclosed in U.S. Pat. No. 9,061,533 to McHugh and U.S. Pat. No. 7,412,999 to Lvovskiy et al.

McHugh teaches a motorized abrasion component protruding radially outwardly, such as a cylindrical brush with flexible bristles that is motor driven but hand held. It is difficult to envision the use of this motorized device on small prescription bottles held in the hand without safety concerns from rotating bristles.

Similarly, Lvovskiy et al. proposes a hand held label remover with a grinding wheel and electric motor for use on soft materials, such as boxes.

In an even more complicated arrangement, U.S. Pat. No. 8,459,578 to Fischer discloses a prescription label identity peeler that comprises a box with a lid forming a housing around a motorized sanding member in which a pill bottle is mechanically rotated against the sanding member. Obviously, this is a rather complex and expensive device, rendering it undesirable for home use.

Even more elaborate motorized mechanical devices are disclosed in U.S. Pat. Nos. 8,479,797 and 5,152,865 to Hurst.

U.S. Pat. No. 8,479,797 discloses a conveyor system and a ram to force glass vials through a first set of slitter blades and a second set of scrapper blades to remove the label in strips. It is not clear that this device would operate effectively on plastic bottles common in the prescription business, as the spring-loaded scrapper blades could easily gouge the plastic bottle. This elaborate mechanical device is also not practical for everyday use in a home due to expense and safety considerations regarding a ram and multiple blades.

In the earlier U.S. Pat. No. 5,152,865, an apparatus is disclosed for removing an adhesive backed label from a cylindrical container by mechanically forcing a blade between the adhesive and the container while rotating the container and peeling the label from the container.

U.S. Pat. No. 5,718,030 to Langmack et al. describes a conveyor system with a motorized abrasive wire bristle device rotated at high speed (3000-4000 rpm) to flick off the label of a bottle, while U.S. Pat. No. 4,944,832 to Abe et al. describes a mechanical device for holding or moving a bottle or container against a flexible cylindrical blade. Again, these are relatively complex and expensive configurations that may not be feasible for home use.

While it is obvious that the art has sought a means for removal of labels, none has provided a simple, inexpensive, hand held, non-motorized system that reliably shreds the label of prescription bottles and renders PHI illegible.

SUMMARY OF THE INVENTION

In one respect, the present invention is directed to a label degrading device including a generally cylindrical collar having a circumferential wall with an inner surface and an outer surface and a plurality of teeth extending radially inwardly from the inner surface of the circumferential wall of the collar. A longitudinal slot is formed along and passing completely through the circumferential wall of the collar to define opposing edges of the circumferential wall, such that when the collar is squeezed by a user, the circumferential wall flexes inwardly and the opposing edges defined by the slot move toward each other, whereby the teeth are adapted to destructively engage a label carried on a vessel over which the collar is disposed such that hand twisting of the collar around the vessel renders illegible information printed on the label.

In some embodiments, the collar comprises a polymeric material. In certain of these embodiments, the polymeric material comprises at least one of polypropylene and polycarbonate. In certain embodiments, the polymeric material further comprises a glass additive, such as at least one of silica, talc and mica. In some embodiments, the polymeric material comprises from 10%-60% by weight of the glass additive, particularly from 30%-40% by weight of the glass additive.

In some embodiments, the teeth comprise polymeric teeth integrally formed with the circumferential wall. In some embodiments, the collar comprises a plurality of rows of teeth, each row comprising at least two teeth, wherein the plurality of rows are longitudinally separated from each other.

In some embodiments, the device further includes a flexible metal insert disposed on the inner surface of the circumferential wall, wherein the teeth are stamped in the flexible metal insert.

In some embodiments, the device further includes a cap removably attached on a bottom end of the collar, the cap adapted to retain shredded label pieces within the collar. In some embodiments, the device further includes a key formed on the collar, the key adapted to engage an indentation formed in a cap of the vessel, whereby the device acts as a gripping tool to facilitate removal and/or replacement of the cap. In some embodiments, the vessel comprises a prescription bottle.

In some embodiments, the device further includes a plurality of gripping elements disposed on the outer surface of the circumferential wall, the gripping elements adapted to facilitate gripping of the device during twisting. In certain of these embodiments, the gripping elements comprise longitudinally extending ridges extending radially outwardly from the outer surface of the circumferential wall. In some embodiments, the device further includes a visual indicia disposed on the outer surface of the circumferential wall, the visual indicia indicative of a preferred direction of use.

In accordance with another aspect of the invention, a label degrading device includes a generally cylindrical collar formed from a polymeric material and having a circumferential wall with an inner surface and an outer surface, the polymeric material comprising at least one of polypropylene and polycarbonate and at least one glass additive selected from the group consisting of silica, talc and mica. A plurality of longitudinally extending ridges extend radially outwardly from the outer surface of the circumferential wall, the gripping elements adapted to facilitate gripping of the device during twisting. A plurality of teeth extend radially inwardly from the inner surface of the circumferential wall of the collar, the teeth comprising polymeric teeth integrally formed with the circumferential wall. The teeth are formed in a plurality of rows, each row comprising at least two teeth, and the plurality of rows are longitudinally separated from each other. A longitudinal slot is formed along and passing completely through the circumferential wall of the collar to define opposing edges of the circumferential wall, such that when the collar is squeezed by a user, the circumferential wall flexes inwardly and the opposing edges defined by the slot move toward each other, whereby the teeth are adapted to destructively engage a label carried on a vessel over which the collar is disposed such that hand twisting of the collar around the vessel renders illegible information printed on the label.

In accordance with still another aspect of the present invention, a method for degrading a label carried on a vessel comprises the steps of: (i) providing a generally cylindrical collar having a circumferential wall with an inner surface and an outer surface and a plurality of teeth extending radially inwardly from the inner surface of the circumferential wall of the collar, wherein a longitudinal slot is formed along and passing completely through the circumferential wall of the collar to define opposing edges of the circumferential wall; (ii) disposing the collar over the vessel carrying the label; (iii) squeezing the collar with the vessel disposed therein so as to cause the circumferential wall to flex inwardly and the opposing edges defined by the slot to move toward each other, such that the teeth destructively engage the label carried the vessel; and (iv) twisting, by hand, the collar around the vessel thereby rendering illegible information printed on the label.

As mentioned above, the collar is constructed of a synthetic or organic molded thermoplastic material, such as polypropylene or polycarbonate that typically contains a glass additive, including but not limited to silica, talc or mica. One preferred mixture, for example, uses a 30% glass fiber reinforced, chemically coupled, polypropylene compound that can be injection molded or 3D printed into the disclosed form of collar. Such compound is available commercially under the name GC30P100-00 from RheTech of Whitmore Lake, Mich. Another preferred compound is a glass filled polycarbonate compound marketed under the tradename ZELUX®, containing 30% glass additive and manufactured by Westlake Plastics of Chester Heights, Pa.; while yet another is a thermoplastic containing 25% glass additive marketed as CELCON® GC25A and manufactured by Celanese Corporation. Various other thermoplastics and methods of production will be apparent to those skilled in the art and are not described further here. Recycled materials may be used in certain cases.

In a preferred embodiment, the thermoplastic material contains a quantity of between 10%-60% by weight glass additive, and typically between 30%-40%, that when molded into the plastic collar has the benefit of providing sharp points of contact between the teeth and the label. With the addition of the glass additive to the mixture, the sharp points of contact on the teeth are constantly rejuvenated as the material at the points abrades away with repetitive use and new glass fibers are exposed at the point. The glass additive may also be used to improve the hardness and dimensional stability of the plastic, which in turn, helps to maintain the sharpness of the teeth. During manufacturing in the mold, the angles forming the points of the teeth harden first and the glass additive migrates towards the points during the injection process, thereby providing additional strength, durability and cutting capability to the teeth.

While more costly than a molded plastic collar, in certain cases it may be desirable to fabricate or machine the collar from a metal stock or to punch abrading rasp like protrusions through a thin metal cylindrical sleeve or collar.

A typical collar, as identified in the attached drawings, is generally of a cylindrical form measuring 1.280 inches in length by 1.25 inches inside diameter as measured from point to point of diametrically opposing teeth. The cylinder is ergo dynamically designed to fit comfortably in the human hand and is generally molded with a plurality of ridges on the outside circumference to assist with grasping during application of the device. Other variations may have gripping dots or nubs on the outside surface or be assembled with a gripping sleeve made from neoprene or other suitable material.

In a preferred form, the device fits comfortably over a standard U.S. prescription bottle of 13 drams, that measures approximately 1.245 inches in outside diameter at the trailing edge. The distance between the shredding points at 1.25 inches in this case is slightly larger than the bottle diameter at the trailing edge. Typically the dimension between opposing points of the teeth will be 0%-5% greater than the outside diameter of the bottle at the trailing edge so as to allow the collar to fit over the bottle while providing easy contact of the points to the label with minimal hand pressure applied to the collar. In some cases, especially with tapered bottles, the point-to-point diameter may be a few percent less than the bottle diameter; however the longitudinal slot and the flexible material of construction allow the collar to expand as needed.

Larger sizes of prescription bottles are easily addressed with larger diameter collars. Generally, collars will be produced in sizes designed to fit commercially available prescription bottles in sizes of 8-48 drams with bottle diameters of approximately 1.0 inch to 2.0 inches. But larger size collars are viable, up to 3 inches or even 4 inches in diameter. A single collar size may fit several different dram size bottles within a particular range given the inherent flexibility of the collar.

A longitudinal slot in the collar provides flexibility to easily slip the collar over the bottom end of the bottle and allows the collar to then be squeezed by hand and compressed to more tightly fit the collar to the bottle. Squeezing the collar in turn engages the teeth on the inside of the collar to be in firm contact with the label on the bottle. While the slot size can be varied, a typical slot width (as shown in the attached figures) is 0.25 inches to 0.30 inches for the collar fitting a standard 13 dram prescription bottle, but slot size may be increased to 0.35 inches to more than 0.5 inches for larger diameter collars useful on larger sized bottles.

The teeth on the inside of the collar are precision fabricated as part of the manufacturing process, although external teeth or points can be added to the collar following fabrication. The teeth are generally designed in a staggered array of multiple rows (as shown in the figures) and may consist, for example, of two rows of teeth, or of a first row of cutting teeth and then a second row of scrapping teeth. The arrangement can also include a third row of teeth that can be designed for further cutting or scraping. In alternative arrangements, a row of wiping or scraping teeth can be fabricated in the collar to help remove the label as it is loosened from the bottle by the cutting teeth.

The points of the cutting teeth are generally fabricated at a complex angle that is typically 18-30 degrees from the vertical wall of the collar but preferably 22-28 degrees. The contact angle of the point is typically formed with a 45-degree chamfer. The thickness of a cutting tooth is 0.080 inches while the depth from the point to the inside circumference of the collar is generally 0.123 inches. Overall vertical length of an individual tooth is typically within a range of 0.3 inches to 0.5 inches and may vary between rows. While these are dimensions that have been found to provide strength and durability to the teeth during cutting, scraping and shredding, they are not intended to be restrictive and other dimensions and angles may also be useful.

The number of teeth in any row, the number of rows, the spacing between the teeth and the length of the teeth can be varied for optimum label degradation (based on the dram size of the bottle or other factors) with minimal twisting effort. It has been found that a total number of teeth between 21 and 26 is generally acceptable for collar sizes fitting standard prescription bottles of 13-48 drams, which teeth are generally split between the top and bottom row. Typical radial spacing between teeth can vary, but a range of 13-15 degrees between teeth has been found to be effective.

By placing the collar over the bottom end of the bottle, and moving it by hand towards the top of the bottle (cap end) the teeth are lightly engaged with the label and the degradation process begins. Squeezing the collar around the bottle further engages the teeth to the label and a manual twisting action of the collar around the bottle starts the cutting, scraping and shredding of the label by the teeth so that personal health information on the label becomes illegible.

Typically, the length of the collar is approximately 1.280 inches, which is roughly one half the length of a standard 13 dram pill bottle, but it can be shorter, the same length or longer than the bottle. When the collar is longer than the pill bottle, it may or may not have additional rows of teeth across its length versus the standard collar. It may also have a closed end or removable cap on the trailing end of the collar such that the label shreds are retained in the collar and available for subsequent disposal by removing the cap to empty the collar or tipping the collar to empty it of label shreds. In still other cases, a collection bag or a vacuum line can be attached to the trailing end of the collar to collect the label shreds. The point of attachment can be fixed or removable and may include a swivel joint such that the collection mechanism does not interfere with the twisting action applied to the collar during use.

In other cases the collar can have a trailing row with a single or multiple protruding plastic keys that fit the indentations common on the plastic caps of pill bottles. By placing the trailing edge of the collar over the cap such that the key fits into a least one indentation in the cap, the collar becomes a simple tool that offers the ability to more easily remove or replace caps to the open end of a prescription bottle. The key can be fabricated as an integral part of the collar with the pointed teeth, or it may be manufactured as a stand-alone collar with just a key.

In a preferred embodiment, the upper end of the collar, or leading edge, has a flat end/edge such that the collar fits snuggly to the cap of the prescription bottle which allows degradation of the label and personal information located near the top of the label. The trailing end can have a beveled or rounded shape to make it more ergo dynamically comfortable to the user when squeezing and hand twisting the collar around a pill bottle. A molded, embossed, printed or adhesive arrow is used to indicate the leading edge of the collar. While not intended to be restrictive, it is generally advantageous to position the collar as directed by the arrow such that the minimum dimension of the teeth forms the leading direction, which makes fitting of the collar to the bottle easier.

In a typical application of the present invention:

1. The bottom of the prescription bottle is fitted into the collar with the bottle cap facing up and the arrow on the collar pointing up towards the bottle cap.
2. While holding the bottle at the cap end with one-hand, the collar is manually squeezed around the bottle with the other hand, thus engaging the teeth against the label.
3. By twisting the collar around the bottle while applying pressure and migrating the collar up and down the body of the pill bottle, the label degradation process takes place. In other cases, the bottle can be twisted in one direction (for example, clockwise) while the collar is twisted in the opposite direction (counter-clockwise).
4. The bottle is then removed from the collar and inspected. The process can be repeated if needed to more completely degrade the label.
5. The bottle is then disposed of in a recycling receptacle or placed in with the household waste stream.
6. The shredded label pieces are collected and discarded in the trash.

In some other embodiments, the collar can serve as a holder for a removable cylindrical insert that may be made of plastic, ceramic or metal material. Such insert can have teeth, or pointed protrusions (rasp like) that are useful in degrading the label. The arrangement of teeth or rasp protrusions can be designed for efficient cutting and scraping of the label. While the insert can extend the length of the collar, it can also be less than the length of the collar, for example, one-third the length of the collar. The insert can be over-molded into the plastic collar, ultrasonically welded, glued, threaded or otherwise affixed to the collar in a permanent or removable manner. It can be mounted at the leading end of the collar, in between the two rows of hardened plastic teeth, or on the trailing end of the collar. It can also be used alone, with the collar acting simply as a holder for the insert.

As the cutting and shredding performance potentially degrades with time and usage, a removable insert can provide an advantage in that it can be removed and replaced with a fresh insert. In general the insert will be contained within the collar but it may protrude beyond the length of the collar on either end or both ends of the collar. The insert can be a continuous piece, slotted like the collar, or formed with a sliding overlap allowing movement, such that it generally does not interfere with the pressure necessary to be applied to the collar to engage the teeth of the insert into the label. In some cases the collar may have pre-fabricated permanent plastic teeth and also retain a fixed or removable insert section with additional teeth or sharp rasp like protrusions.

The invention as described above provides a low cost, safe and easy method for removing personal health information from prescription pharmaceutical bottles.

DETAILED DESCRIPTION OF THE INVENTION

Figure 1:
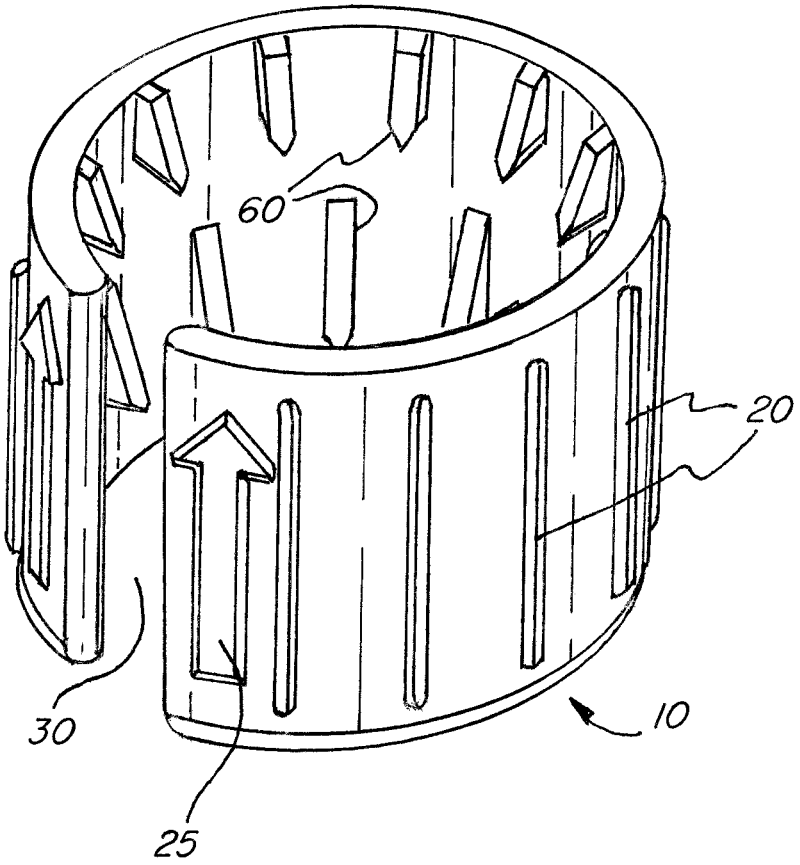
FIG. 1 is an isometric view illustrating a prescription bottle label degrader according to an exemplary embodiment of the present invention.

Referring now to the Figures and first to FIG. 1, there is shown an exemplary embodiment of a collar (10) particularly useful for removing labels from a standard 13 dram prescription pill bottle (not shown) with a typical bottle diameter of 1.20 inches to 1.245 inches at the trailing end. The external surface of the molded plastic collar (10) contains multiple longitudinally extending ridges (20), typically from 3-15 ridges, to assist in gripping and twisting the collar (10). Other gripping mechanisms, such as nubs, can be molded or added to the external surface of the collar (10) to assist with gripping. Directional arrow (25) shows the preferred alignment of the collar (10) when fitted to the closed end of the bottle. The arrow (25) can be molded, printed or affixed with adhesive.

A longitudinal slot (30) formed in the collar (10) allows flexibility for the collar (10) to be expanded when fitted over the end of a pill bottle, but more importantly, allows the collar (10) to be compressed once fitted over the bottle. Typically, the slot dimension is 0.25 inches to 0.30 inches, but it can be as much as 0.5 inches or more for larger diameter collars. Hand compression of the collar (10) allows teeth (60) on the inside circumference to be engaged against the label with only slight hand pressure applied to the collar (10).

Figure 2A:
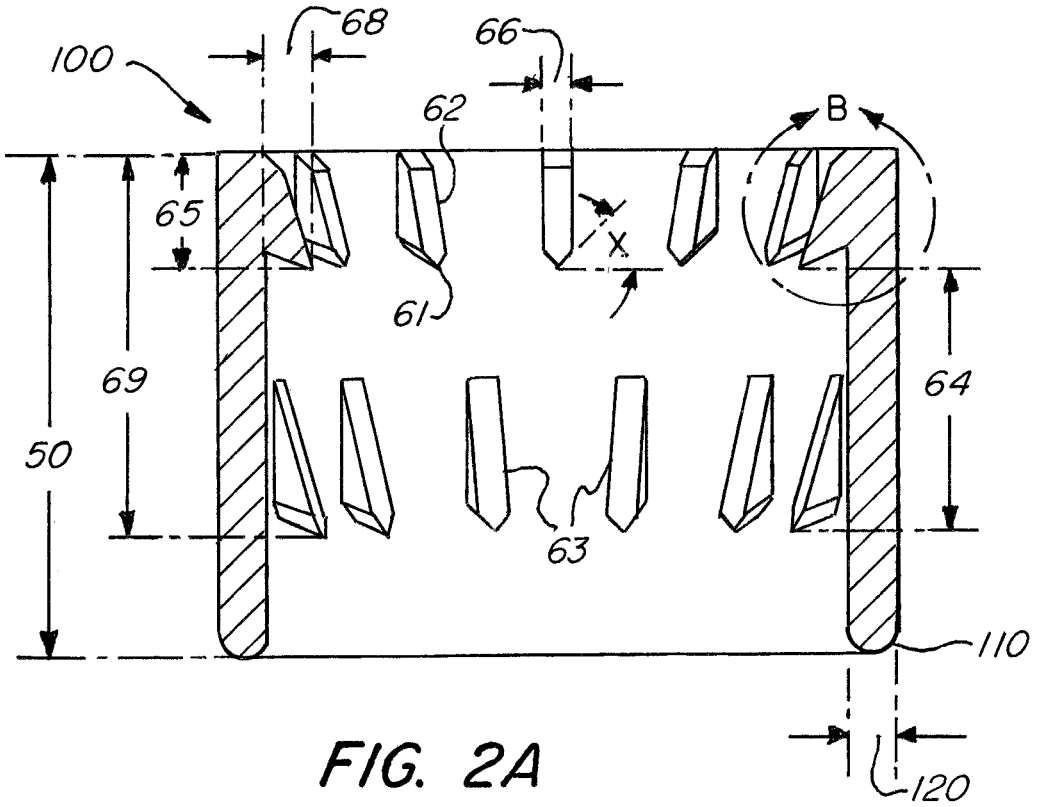
FIG. 2A is a partial cross-sectional view of the prescription bottle label degrader shown in FIG. 1.

FIG. 2A shows a collar (10) with an overall length (50) of 1.280 inches, though the length generally will be from 1 inch to 2 inches for a 13 dram bottle. Collar (10) in FIG. 2A has teeth (60) that are preferably arranged in two or more rows on the collar (10) such that the points (61) of the leading edge teeth (62) are generally 0.30 inches below the leading edge (100) of the collar (30); so that when hand twisted, the points (61) engage the label at the location where personal information generally begins. Other dimensions can, of course, be accommodated.

In FIG. 2A, the upper row of teeth (62) has 11 teeth and a lower row of teeth (63) has 10 teeth. The total number of teeth is generally between 21 and 26. Teeth (60) are staggered and offset from one row to the other to assist with scrapping, shredding and removal of label material and PHI. Points (61) on the teeth (60) in FIG. 2A are formed from complex angels during manufacturing but could also be punched from a metal sleeve (rasp like) or established by pointed setscrews inserted externally through the collar circumference. The distance (64) between rows is typically 0.5 inches to 0.7 inches measured from point (61) to point (61).

The teeth (60) are generally 0.3 inches to 0.4 inches in length (65) and 0.08 inches thick (66) and protrude from the inside wall of the collar by a distance (68) of 0.123 inches towards the central axis of the collar (10).

Figure 2B:
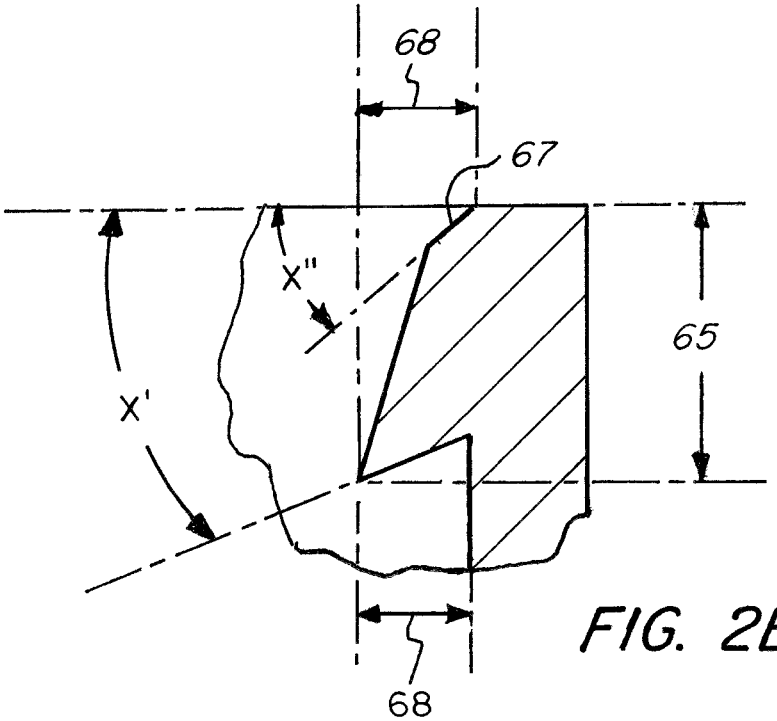
FIG. 2B is detail view illustrating a portion of the FIG. 2A in greater detail.

FIG. 2B shows the details of a typical cutting tooth (60) in the top row (62) with details on the angles producing point (61). While not intending to be bound to the example in FIG. 2B, each tooth (60) extends 0.123 inches from the vertical wall (68) and the complex angle (X') is 22 degrees, but angles of 18-28 degrees are also useful. Angle (X) forming the point (61) in FIG. 2A is preferably 45 degrees. The length (65) of tooth (62) in FIG. 2B is 0.302 inches from the leading edge of the collar to the point of the tooth (62), which length (65) has been found generally sufficient to engage the top portion of a label closest to the pill bottle cap, which portion contains PHI to be degraded. A length (65) of 0.3 inches to 0.4 inches is generally acceptable for a tooth, but that length can be longer or shorter if desired. Shelf (67) at the top of tooth (62) is defined by angle (X") which is 45 degrees in FIG. 2B.

Figure 3:
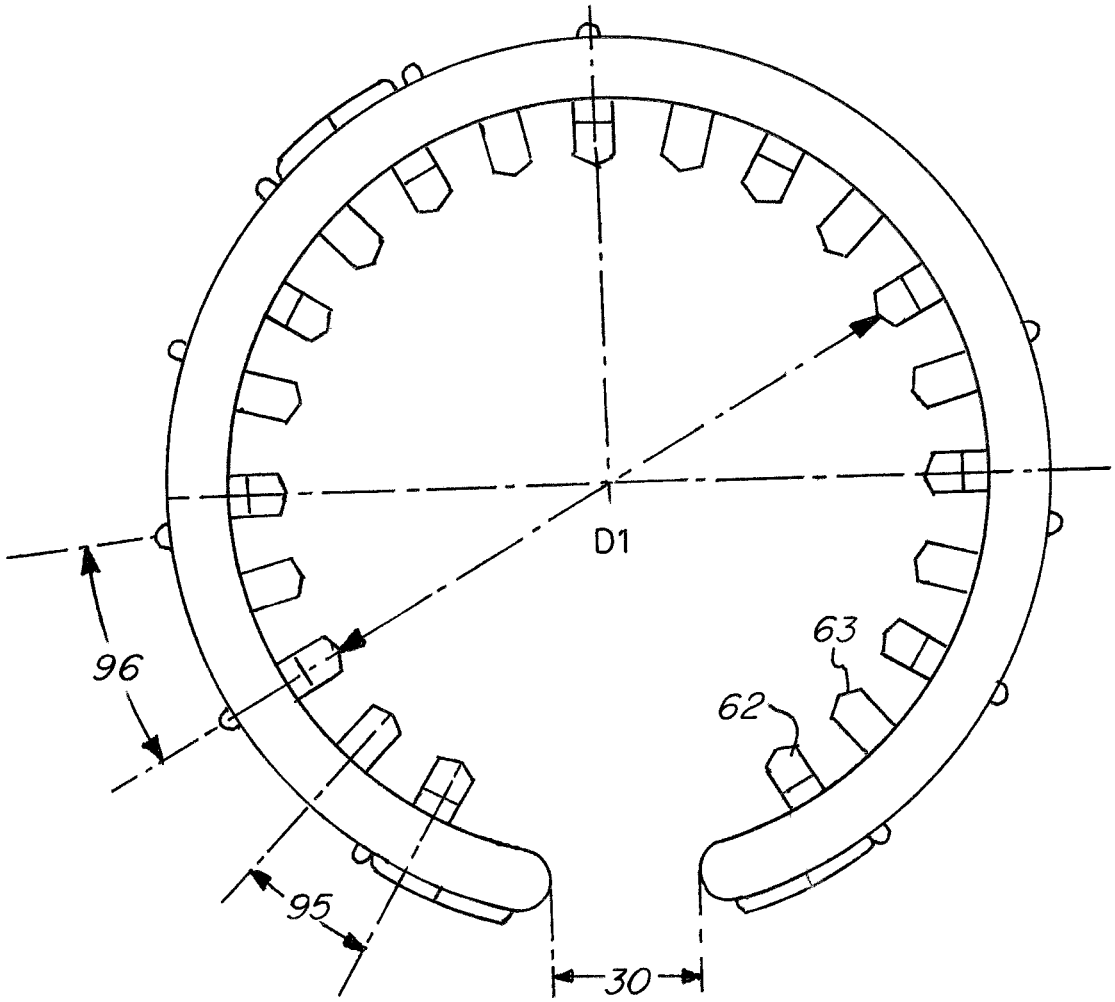
FIG. 3 is a top plan view of the prescription bottle label degrader shown in FIG. 1.

In general, as shown in FIG. 3, the dimension (D1) from diametrically opposed points (61) on the teeth (60) will be from 0-5% greater than the dimension of the bottle diameter. In FIG. 3 for example, dimension (D1) is 1.25 inches versus a bottle diameter of 1.20 inches to 1.245 inches for a typical 13 dram prescription bottle. This allows the collar to be easily moved up the length of the pill bottle and subsequently the teeth (60) are engaged by a simple squeezing of the collar (10) around the bottle. Spacing (95) of the teeth (60) is generally every 13-15 degrees on the inside circumference alternating between the top teeth (62) and the bottom teeth (63), but other spacing can be used. Generally, two to three teeth are eliminated at and adjacent to the longitudinal gap (30). Spacing (96) of the longitudinal gripping ridges (20) is typically every 18-24 degrees on the outside circumference, but some ridges may be removed to allow for the placement of logo, serial number, patent information or the like.

The leading edge (100) of the collar (10) can be flat, as shown in FIG. 2A, to fit against the cap, and the trailing edge (110) is typically beveled or rounded to provide a more comfortable grip. The thickness (120) of the molded collar (10) can be 0.125 inches, which provides both strength and flexibility during hand twisting; but other dimensions are also useful.

Twisting the collar (10) around bottle will degrade the label by cutting and scraping and shredding the label through contact with the teeth (60). It will be obvious to one skilled in the art is that larger diameter collars (10) can be designed for larger diameter bottles. The slot size (30) can also be increased from 0.25 inches to a larger dimension, for example 0.5 inches, and the number of teeth (60) can be increased for the larger circumferential area on a larger collar (10).

Figure 4A:
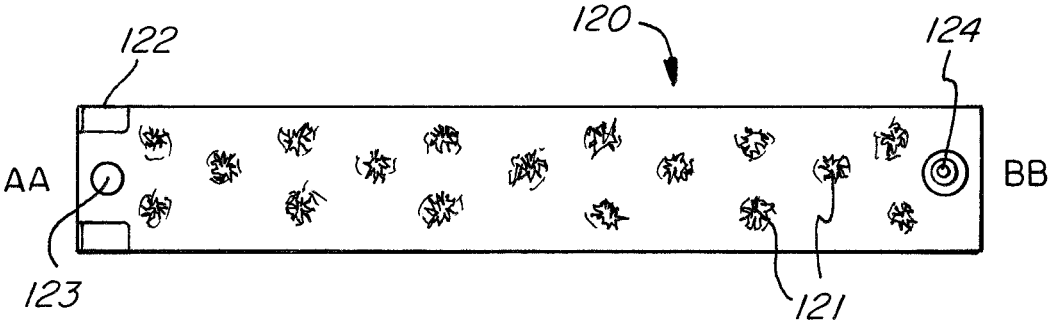
FIGS. 4A and 4B schematically illustrating a rasp like insert that may be used with the prescription bottle label degrader shown in FIG. 1 instead of or in addition to the teeth.
Figure 4B:
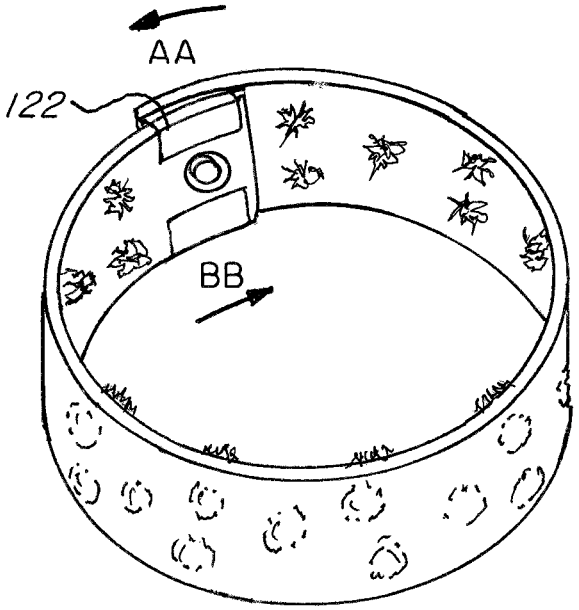

FIGS. 4A and 4B show a rasp like flexible metal insert (120) designed to fit into a plastic collar (10) as a permanent or replaceable sleeve alone or in combination with the plastic teeth (60). As indicated, the flexible metal insert (120) can be folded with end (AA) overlapping end (BB) such that the sharp points of the rasp (121) are positioned on the internal circumference for use in shredding of the label. In the case of a replaceable insert, the collar may have a channel into which the insert can be aligned and retained such that end (AA) fits over end (BB) and is secured together by small clips (122) or by a rivet and hole arrangement (123, 124) yet able to slide on itself as the collar (10) is compressed or expanded. When the insert (120) is affixed to the collar (10) in a permanent fashion, however, the insert will normally instead have a gap that matches the gap (30) on the collar (10).

The insert (120) can be secured to the inside circumference of the collar (10) by over-molding, ultrasonic welding or other means readily known to one skilled in the art of injection molding of plastic parts. The insert (120) is preferably mounted at the top of the collar, in which case it may replace the first row of plastic teeth (62), but it can also be mounted alone in the top or middle of the collar (10) without teeth; or in certain configurations, it may be mounted between the two rows of plastic teeth or serve as a replacement for the first row of molded plastic teeth (62).

Figure 5A:
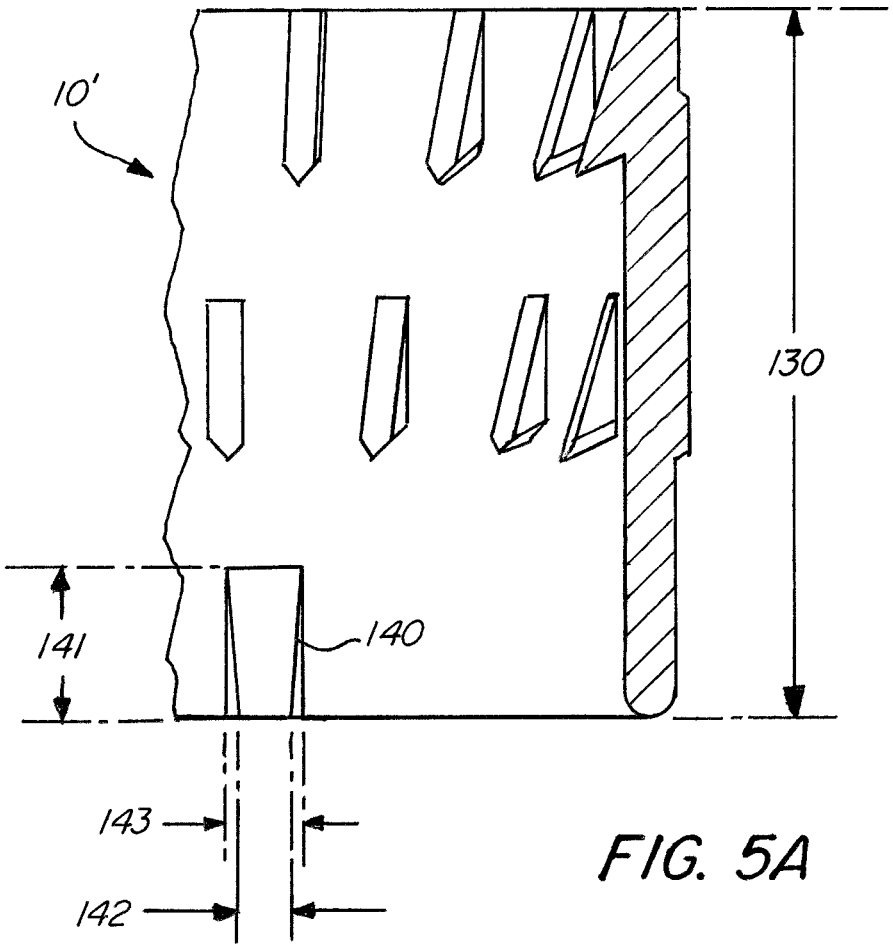
FIG. 5A is a partial cross-sectional view of the prescription bottle label degrader shown in FIG. 1 but further including a key that may be employed to assist in removing the cap from a prescription bottle.
Figure 5B:
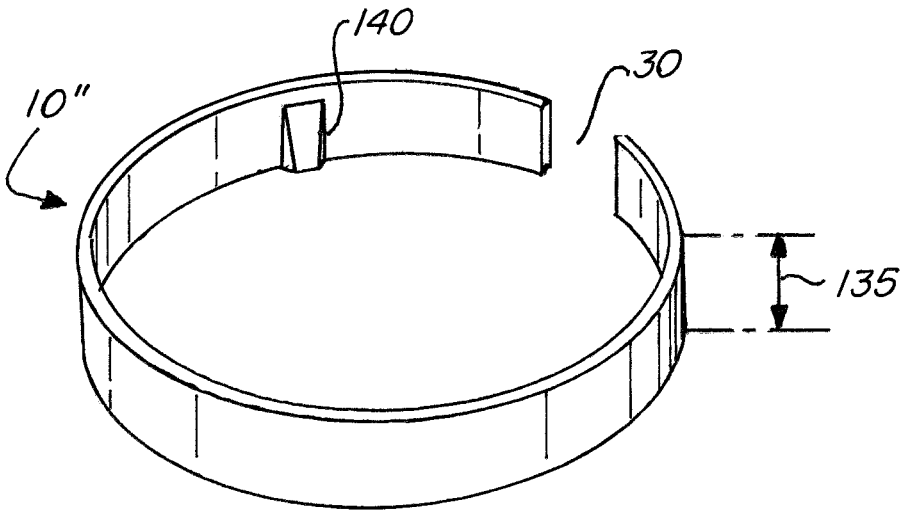
FIG. 5B is an isometric view of a collar incorporating the key shown in FIG. 5A, but without teeth for degrading a label.
Figure 5C:
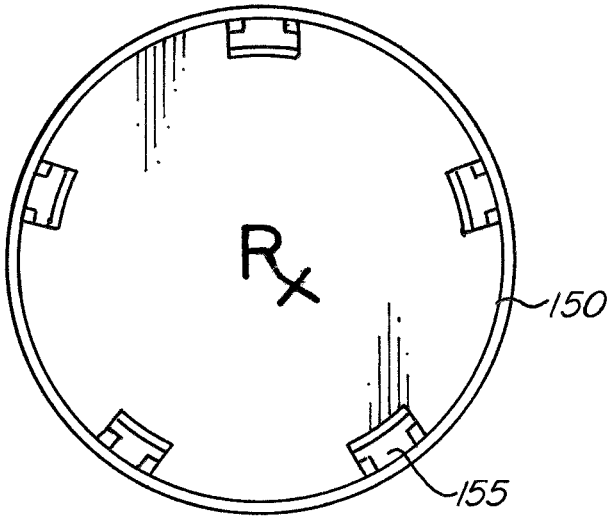
FIG. 5C schematically illustrates a typical prescription bottle cap with indentations into which the key shown in FIGS. 5A and 5B may be fitted.

FIG. 5A shows a collar (10') having a slightly greater length (130) comprising a third row with a single blunted tooth acting as a key (140). This is useful in placing the trailing end of the collar over the cap (150) of the bottle such that the key (140) fits the indentations (155) now becoming common on the plastic cap of prescription bottles, where such a cap (150) is shown in FIG. 5C. While holding the bottle and positioning the trailing end of the collar (10') so that the key (140) is aligned with a cap indentation (155), a simple compression and twisting of the collar (10') can be used to easily remove or replace the cap (150) to a prescription bottle.

A single key (140) or multiple keys can be used, but a single key is more widely applicable as caps can vary in the number of indentations and a single key has been found to be sufficient. The key (140) will generally have a tapered dimension being narrower at the trailing end (143) than at the leading edge (142) and will preferably be positioned at the trailing end of the collar (10'). While the height (141) of the key (140) is typically 0.350 inches to 0.375 inches, it can be longer or shorter. In general the depth of the key (140), for example at 0.090 inches, will be slightly less than the depth (68) of the teeth (60) on a collar (10'), for example at 0.123 inches, so as not to interfere with the engagement of the teeth (60) to the label when a dual function device is used for label shredding.

While a dual function device is presented in FIG. 5A, either feature of the scraping teeth or cap removal key may be fabricated and used in a separate collar (10"), or combined as a dual function device (10'). When used as a separate collar (10") as in FIG. 5B, the overall height (135) of a separate collar (10") with just a key (140) is preferably 0.6 inches to 1.5 inches, but other heights are also practical. Gap (30) is not required for the separate collar (10") with just a key (140), but is preferred for added flexibility in fitting the collar (10") with a key (140) to the prescription bottle cap (150).

Figure 6:
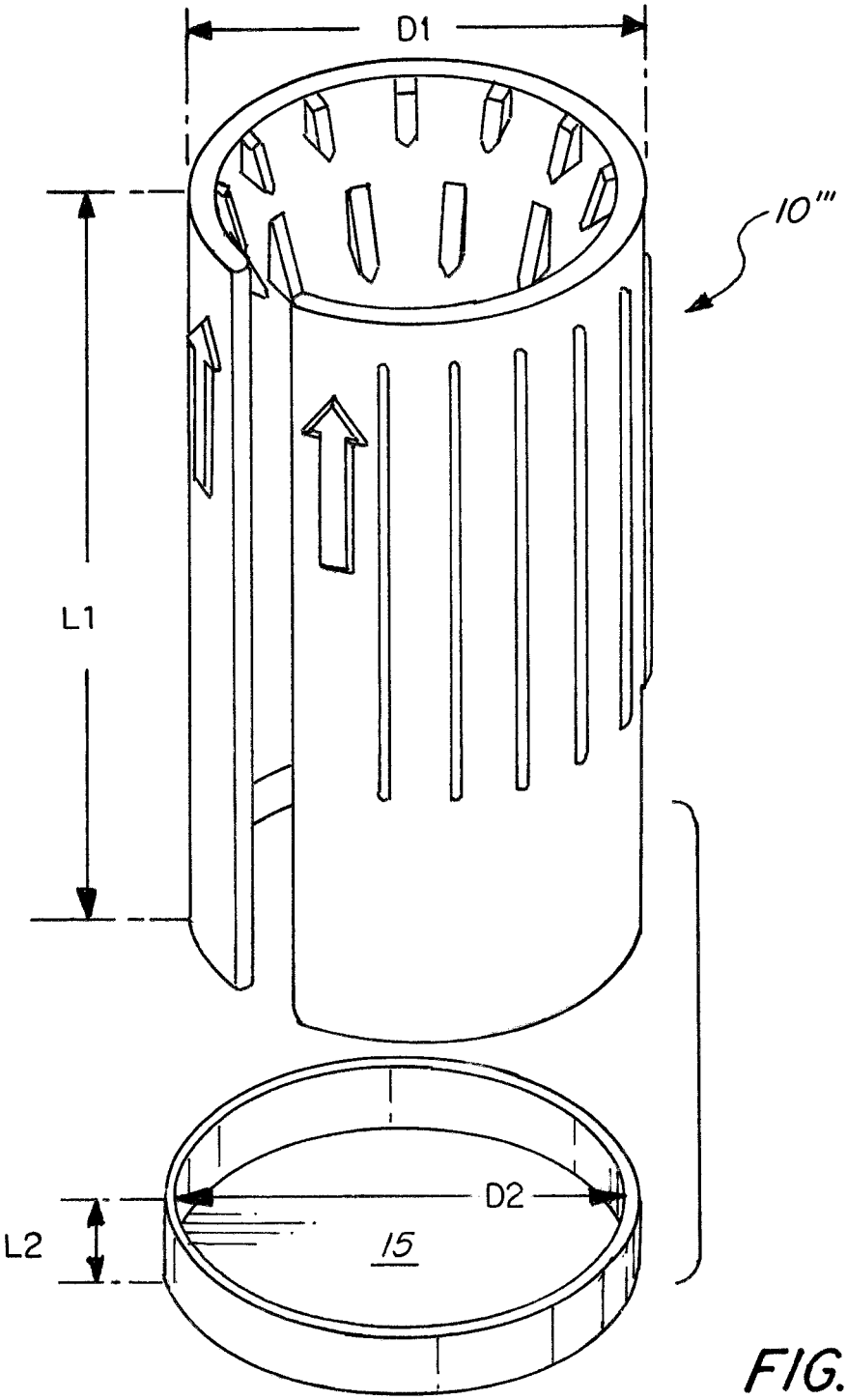
FIG. 6 is an isometric view illustrating a prescription bottle label degrader similar top that shown in FIG. 1 but further including a snap on cap intended to collect and retain label shreds.

FIG. 6 shows a collar (10''') of extended length (L1), where the length (L1) of the collar (10''') is greater than the length of a prescription bottle by 0.2 inches to 0.5 inches, or even 1 inch to 2 inches to allow a cap (15) to be fitted to the trailing end of the collar (10''') for the collection and retention of label shreds. When the collar (10''') is in a non-compressed state it has a typical outside diameter (D1) of 1.70 inches to 1.75 inches, for example. Plastic cap (15) has a slightly smaller inside diameter (D2), for example 1.65 inches, that allows it to snap over the trailing edge of the collar (10''') and slightly compress the collar (10''') such that the cap (15) is retained in place. The cap (15) collects and retains the label shreds as the collar (10''') degrades the label. A typical height (L2) for the collection cap (15) is 0.4 inches to 0.6 inches. The cap (15) can be removed from the collar (10''') and label shreds can then be disposed in a waste receptacle.

Although the invention has been described with reference to particular arrangement of parts, features, and the like, these are not intended to exhaust all possible arrangements or features, and indeed many modifications and variations will be ascertainable to those of skill in the art.

What is claimed is:

1. A label degrading device, comprising:

a generally cylindrical collar having a circumferential wall with an inner surface and an outer surface, the circumferential wall of said collar comprising a top portion adjacent to a first longitudinal end of said collar and a bottom portion adjacent to a second longitudinal end of said collar;

a plurality of teeth extending radially inwardly from the inner surface of the top portion of the circumferential wall of said collar, each of said plurality of teeth having a point, and wherein the points of said plurality of teeth collectively define a generally cylindrical shape;

wherein a longitudinal slot is formed along and passing completely through the circumferential wall of said collar to define opposing edges of the circumferential wall, such that when said collar is squeezed by a user, the circumferential wall flexes inwardly and the opposing edges defined by the slot move toward each other, whereby the teeth are adapted to destructively engage a label carried on a vessel over which said collar is disposed such that hand twisting of the collar around the vessel renders illegible information printed on the label;

a key formed on the collar, the key comprising a member extending radially inwardly from the inner surface of the bottom portion of the circumferential wall of said collar and extending longitudinally from the second longitudinal end of the circumferential wall along a length of the bottom portion of the circumferential wall of said collar, the key adapted to engage an indentation formed in a cap of the vessel, whereby the device acts as a gripping tool to facilitate removal or replacement of the cap;

wherein no teeth are present on the bottom portion of the circumferential wall of said collar; and wherein said collar and said teeth comprise a polymeric material compound having a glass additive mixed therein.

2. The device claim 1 wherein the polymeric material comprises at least one of polypropylene and polycarbonate.

3. The device of claim 1 wherein the glass additive comprises at least one of silica, talc and mica.

4. The device of claim 1 wherein the polymeric material compound comprises from 10%-60% by weight of the glass additive.

5. The device of claim 4 wherein the polymeric material compound comprises from 30%-40% by weight of the glass additive.

6. The device of claim 1 wherein the teeth are integrally formed with the circumferential wall.

7. The device of claim 1 wherein the collar comprises a plurality of rows of teeth, each row comprising at least two teeth, wherein the plurality of rows are longitudinally separated from each other.

8. The device of claim 1 wherein the device is adapted to destructively engage a label carried on a prescription bottle.

9. The device of claim 1 further comprising a plurality of gripping elements disposed on the outer surface of the circumferential wall, the gripping elements adapted to facilitate gripping of the device during twisting.

10. The device of claim 9 wherein the gripping elements comprise longitudinally extending ridges extending radially outwardly from the outer surface of the circumferential wall.

11. The device of claim 1 further comprising a visual indicia disposed on the outer surface of the circumferential wall, the visual indicia indicative of a preferred direction of use.

12. The device of claim 1 further comprising a cap removably attached on a bottom end of said collar, the cap adapted to retain shredded label pieces within the collar.

13. A label degrading device, comprising:

a generally cylindrical collar formed from a polymeric material compound and having a circumferential wall with an inner surface and an outer surface, the circumferential wall of said collar comprising a top portion adjacent to a first longitudinal end of said collar and a bottom portion adjacent to a second longitudinal end of said collar;

wherein the polymeric material compound comprises at least one of polypropylene and polycarbonate and at least one glass additive mixed therein, the at least one glass additive selected from the group consisting of silica, talc and mica;

a plurality of longitudinally extending ridges extending radially outwardly from the outer surface of the circumferential wall, the ridges adapted to facilitate gripping of the device during twisting;

a plurality of teeth extending radially inwardly from the inner surface of the top portion of the circumferential wall of said collar, the teeth comprising polymeric teeth integrally formed with the circumferential wall, and wherein the teeth are formed in a plurality of rows, each row comprising at least two teeth, and wherein the plurality of rows are longitudinally separated from each other;

a key formed on the collar, the key comprising a member extending radially inwardly from the inner surface of the bottom portion of the circumferential wall of said collar and extending longitudinally from the second longitudinal end of the circumferential wall toward another longitudinal end along a length of the bottom portion of the circumferential wall of said collar, the key being sized and shaped to engage an indentation formed in a cap of the vessel, whereby the device acts as a gripping tool to facilitate removal or replacement of the cap;

wherein no teeth are present on the bottom portion of the circumferential wall of said collar; and wherein a longitudinal slot is formed along and passing completely through the circumferential wall of said collar to define opposing edges of the circumferential wall, such that when said collar is squeezed by a user, the circumferential wall flexes inwardly and the opposing edges defined by the slot move toward each other, whereby the teeth are adapted to destructively engage a label carried on a vessel over which said collar is disposed such that hand twisting of the collar around the vessel renders illegible information printed on the label.

14. The device of claim 13 wherein the polymeric material compound comprises from 10%-60% by weight of the glass additive.

15. The device of claim 14 wherein the polymeric material compound comprises from 30%-40% by weight of the glass additive.

16. The device of claim 13 further comprising a cap removably attached on a bottom end of said collar, the cap adapted to retain shredded label pieces within the collar.

17. The device of claim 13 wherein the device is adapted to destructively engage a label carried on a prescription bottle.

18. The device of claim 13 further comprising a visual indicia disposed on the outer surface of the circumferential wall, the visual indicia indicative of a preferred direction of use.

19. A label degrading device, comprising:

a generally cylindrical collar having a circumferential wall with an inner surface and an outer surface, the circumferential wall of said collar comprising a top portion adjacent to a first longitudinal end of said collar and a bottom portion adjacent to a second longitudinal end of said collar;

a plurality of teeth extending radially inwardly from the inner surface of the tom portion of the circumferential wall of said collar, each of said plurality of teeth having a point, and wherein the points of said plurality of teeth collectively define a generally cylindrical shape;

wherein a longitudinal slot is formed along and passing completely through the circumferential wall of said collar to define opposing edges of the circumferential wall, such that when said collar is squeezed by a user, the circumferential wall flexes inwardly and the opposing edges defined by the slot move toward each other, whereby the teeth are adapted to destructively engage a label carried on a vessel over which said collar is disposed such that hand twisting of the collar around the vessel renders illegible information printed on the label;

a key formed on the collar, the key comprising a member extending radially inwardly from the inner surface of the bottom portion of the circumferential wall of said collar and extending longitudinally from the second longitudinal end of the circumferential wall along a length of the bottom portion of the circumferential wall of said collar, the key adapted to engage an indentation formed in a cap of the vessel, whereby the device acts as a gripping tool to facilitate removal or replacement of the cap;

wherein no teeth are present on the bottom portion of the circumferential wall of said collar; and a flexible metal insert disposed on the inner surface of the circumferential wall, wherein the teeth are stamped in the flexible metal insert.

* * * * *